US005946823A

United States Patent [19]

Yates

[11] Patent Number: 5,946,823

[45] Date of Patent: Sep. 7, 1999

[54] PEDICURE SANDAL SYSTEM

[76] Inventor: Angel E. Yates, 330 Patmell Rd., E-3, Marietta, Ga. 30060

[21] Appl. No.: 09/243,410

[22] Filed: Feb. 1, 1999

[51] Int. Cl.[6] ..... A43B 3/12; A43B 7/26; A43B 7/08

[52] U.S. Cl. ..... 36/11.5; 36/94; 36/101; 36/3 A; 36/141

[58] Field of Search ..... 36/94, 11.5, 101, 36/3 A, 141, 3 R

[56] References Cited

U.S. PATENT DOCUMENTS

| | | | |
|---|---|---|---|
| 1,349,095 | 8/1920 | Parisi . | |
| 1,867,679 | 7/1932 | Riehle et al. . | |
| 1,890,433 | 12/1932 | Cohen . | |
| 2,506,308 | 5/1950 | Maynier | 128/81 |
| 2,507,120 | 5/1950 | Shapiro . | |
| 2,740,207 | 4/1956 | Starensier | 36/8.5 |
| 2,751,693 | 6/1956 | Baker | 36/8.5 |
| 2,808,662 | 10/1957 | Webb | 36/11.5 |
| 3,000,116 | 9/1961 | Ally . | |
| 3,757,774 | 9/1973 | Hatuno . | |
| 4,017,987 | 4/1977 | Perez, Jr. et al. . | |
| 4,047,310 | 9/1977 | Sunoo . | |
| 4,207,880 | 6/1980 | Zinkovich . | |
| 5,369,895 | 12/1994 | Hammerschmidt . | |
| 5,623,734 | 4/1997 | Pugliatti | 2/239 |

*Primary Examiner*—Ted Kavanaugh
*Attorney, Agent, or Firm*—Joseph N. Breaux

[57] ABSTRACT

A pedicure sandal system that includes a sandal assembly having a number of user positionable toe separation cushion assemblies securable to the sole of the sandal assembly for keeping the user's toes separated and a toe cover assembly for shielding the toes having a number of airflow apertures formed therethrough that is securable to the sandal assembly and shaped to cover the user's toes while providing sufficient clearance to prevent contact between the freshly manicured toe nails and the toe cover assembly.

1 Claim, 2 Drawing Sheets

PEDICURE SANDAL SYSTEM

TECHNICAL FIELD

The present invention relates to foot wear items and more particularly to a pedicure sandal system that includes a sandal assembly having a number of user positionable toe separation cushion assemblies securable to the sole of the sandal assembly for keeping the user's toes separated and a toe cover assembly for shielding the toes having a number of airflow apertures formed therethrough that is securable to the sandal assembly and shaped to cover the user's toes while providing sufficient clearance to prevent contact between the freshly manicured toe nails and the toe cover assembly; the pedicure sandal system including two sandal assemblies and two toe area cover assemblies; each sandal assembly including a sole having a number of massaging dimples protruding upwardly therefrom and a number of toe separation cushion sole attachment pin apertures formed into the toe area of the sole, a user adjustable securing strap, a number of toe cover assembly fasteners provided on the side surface surrounding the toe area of the sole, and four toe separation cushion assemblies each including a resilient cushion sized to fit between the toes of a user and a cylinder shaped sole attachment pin projecting outwardly from the resilient cushion, the sole attachment pin being sized to frictionally fit into the toe separation cushion sole attachment pin apertures; each toe area cover assembly including a partially dome shaped toe area cover having a lower perimeter edge provided with perimeter edge fasteners companionate with the toe cover assembly fasteners provided on the side surface surrounding the toe area of the sole to hold the toe area cover in place with respect to the toe area of the sandal assembly; the toe area cover having a number of airflow apertures therethrough for providing airflow to the wearer's newly polished toe nails and an interior toe receiving compartment having sufficient clearance to receive the toes of a wearer therein without requiring contact being the wearer's toenails and the toe area cover.

BACKGROUND ART

Every day women ruin new pedicures while leaving the beauty salon. The pedicure is ruined when the newly polished toe nails are stripped of polish by contact with conventional shoes or accidentally bumping on objects while walking or riding in a car. It would be a benefit, therefore, to have a pedicure sandal system that was adapted to restrict movement of the wearer's toes and that provided an oversized cover for covering and protecting the toes of the user. Because feet are shaped differently, it would be a further benefit to have a pedicure sandal system that included user positionable toe separation cushion assemblies so that proper toe positioning and spacing can be provided to each wearer.

GENERAL SUMMARY DISCUSSION OF INVENTION

It is thus an object of the invention to provide a pedicure sandal system that includes sandal assemblies adapted to restrict movement of the wearer's toes and that are provided with oversized covers for covering and protecting the toes of the user.

It is a further object of the invention to provide a pedicure sandal system that includes user positionable toe separation cushion assemblies to provide proper toe positioning and spacing to each wearer.

It is a still further object of the invention to provide a pedicure sandal system that includes two sandal assemblies and two toe area cover assemblies; each sandal assembly including a sole having a number of massaging dimples protruding upwardly therefrom and a number of toe separation cushion sole attachment pin apertures formed into the toe area of the sole, a user adjustable securing strap, a number of toe cover assembly fasteners provided on the side surface surrounding the toe area of the sole, and four toe separation cushion assemblies each including a resilient cushion sized to fit between the toes of a user and a cylinder shaped sole attachment pin projecting outwardly from the resilient cushion, the sole attachment pin being sized to frictionally fit into the toe separation cushion sole attachment pin apertures; each toe area cover assembly including a partially dome shaped toe area cover having a lower perimeter edge provided with perimeter edge fasteners companionate with the toe cover assembly fasteners provided on the side surface surrounding the toe area of the sole to hold the toe area cover in place with respect to the toe area of the sandal assembly; the toe area cover having a number of airflow apertures therethrough for providing airflow to the wearer's newly polished toe nails and an interior toe receiving compartment having sufficient clearance to receive the toes of a wearer therein without requiring contact being the wearer's toenails and the toe area cover.

It is a still further object of the invention to provide a pedicure sandal system that accomplishes all or some of the above objects in combination.

Accordingly, a pedicure sandal system is provided. The pedicure sandal system includes two sandal assemblies and two toe area cover assemblies; each sandal assembly including a sole having a number of massaging dimples protruding upwardly therefrom and a number of toe separation cushion sole attachment pin apertures formed into the toe area of the sole, a user adjustable securing strap, a number of toe cover assembly fasteners provided on the side surface surrounding the toe area of the sole, and four toe separation cushion assemblies each including a resilient cushion sized to fit between the toes of a user and a cylinder shaped sole attachment pin projecting outwardly from the resilient cushion, the sole attachment pin being sized to frictionally fit into the toe separation cushion sole attachment pin apertures; each toe area cover assembly including a partially dome shaped toe area cover having a lower perimeter edge provided with perimeter edge fasteners companionate with the toe cover assembly fasteners provided on the side surface surrounding the toe area of the sole to hold the toe area cover in place with respect to the toe area of the sandal assembly; the toe area cover having a number of airflow apertures therethrough for providing airflow to the wearer's newly polished toe nails and an interior toe receiving compartment having sufficient clearance to receive the toes of a wearer therein without requiring contact being the wearer's toenails and the toe area cover.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
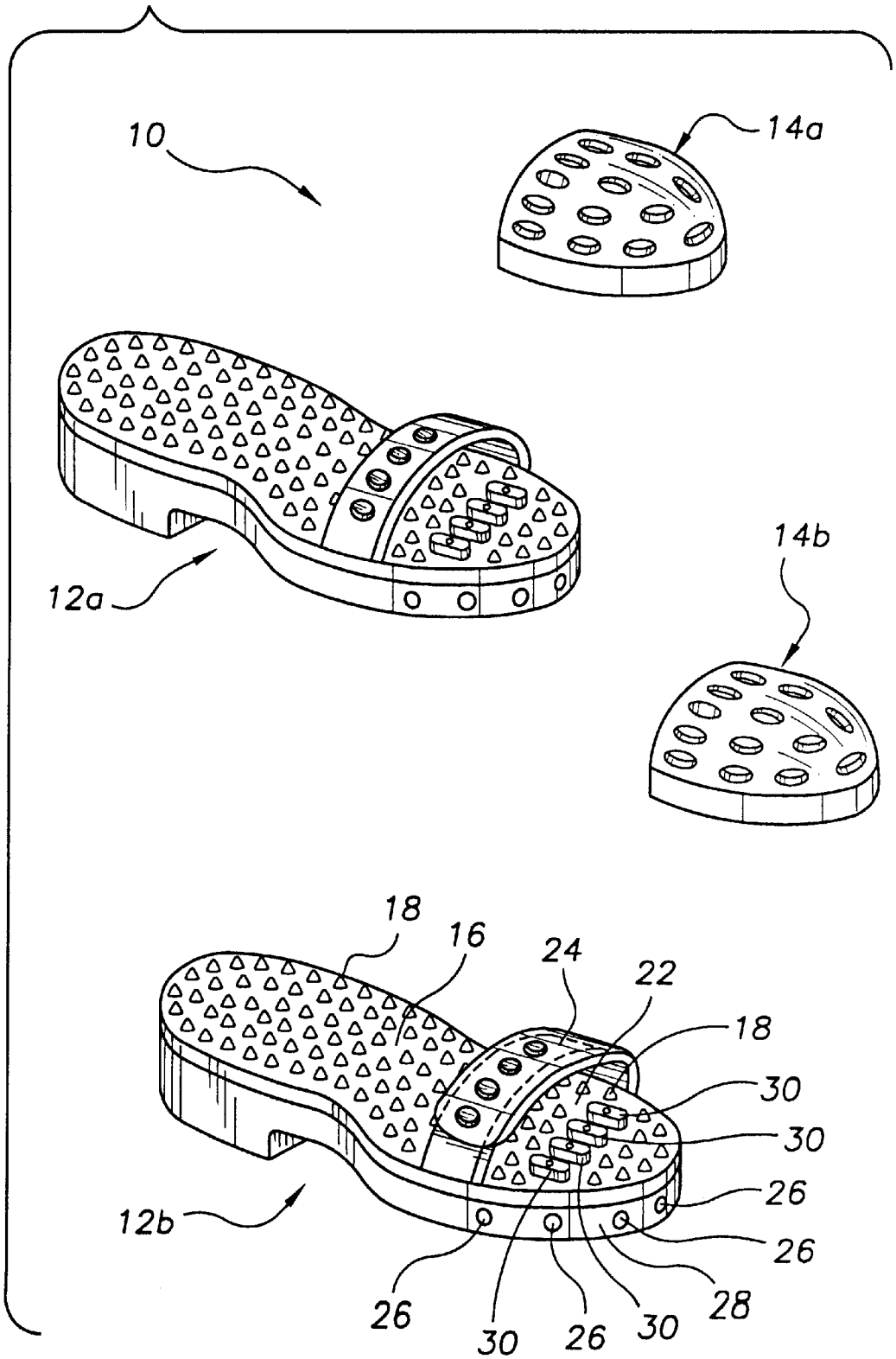
FIG. 1 is a perspective view of an exemplary embodiment of the pedicure sandal system of the present invention showing two sandal assemblies and two toe area cover assemblies; each sandal assembly including a sole having a number of massaging dimples protruding upwardly therefrom and a number of toe separation cushion sole attachment pin apertures formed into the toe area of the sole, a user adjustable securing strap, a number of toe cover assembly fasteners provided on the side surface surrounding the toe area of the sole, and four toe separation cushion assemblies each including a resilient cushion sized to fit between the toes of a user and a cylinder shaped sole attachment pin projecting outwardly from the resilient cushion, the sole attachment pin being sized to frictionally fit into the toe separation cushion sole attachment pin apertures; each toe area cover assembly including a partially dome shaped toe area cover having a lower perimeter edge provided with perimeter edge fasteners companionate with the toe cover assembly fasteners provided on the side surface surrounding the toe area of the sole to hold the toe area cover in place with respect to the toe area of the sandal assembly; the toe area cover having a number of airflow apertures therethrough for providing airflow to the wearer's newly polished toe nails and an interior toe receiving compartment having sufficient clearance to receive the toes of a wearer therein without requiring contact being the wearer's toenails and the toe area cover.

FIG. 1 shows an exemplary embodiment of the pedicure sandal system of the present invention generally designated 10. Pedicure sandal system 10 includes left and right sandal assemblies, generally designated 12*a*, 12*b*, and left and right toe area cover assemblies, generally designated 14*a*, 14*b*. Left and right sandal assemblies 12*a*, 12*b* are substantially the same except one is adapted for the left foot and one adapted for the right foot. Left and right toe area cover assemblies 14*a*, 14*b* are also substantially identical except that one is adapted for the left foot and one adapted for the right foot. The following discussion, while made specifically with respect to the right sandal assembly 12*b* and the right toe area cover assembly 14*b*, is equally relevant to the left sandal assembly 12*a* and the left toe area cover assembly 14*a*.

Figure 2:
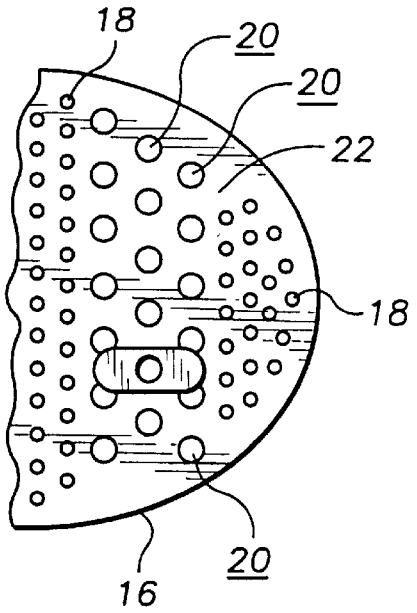
FIG. 2 is a partial top plan view of the toe area of the sole showing a number of massaging dimples, a number of toe separation cushion sole attachment pin apertures formed into the toe area of the sole, and one of the four toe separation cushion assemblies.
Figure 3:
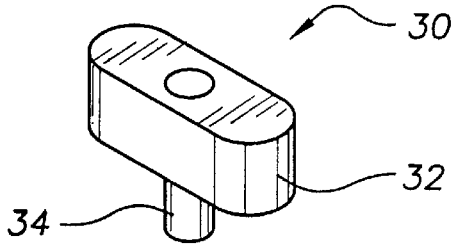
FIG. 3 is a perspective view of one of the four toe separation cushion assemblies in isolation showing the resilient cushion sized to fit between the toes of a user and the cylinder shaped sole attachment pin provided through the resilient cushion and extending outwardly past one side thereof.

Sandal assembly 12*b* includes a molded plastic sole 16 having a number of massaging dimples 18 protruding upwardly therefrom and, referring now to FIG. 2, a number of toe separation cushion sole attachment pin apertures 20 formed into the toe area 22 of the sole, referring back to FIG. 1, a user adjustable securing strap 24, six toe cover assembly fasteners 26 (only four shown) provided on the side surface 28 surrounding toe area 22 of sole X6, and four toe separation cushion assemblies 30. Referring to FIG. 3, each toe separation cushion assembly 30 includes a resilient cushion 32 sized to fit between the toes of a user and a cylinder shaped sole attachment pin 34 projecting outwardly from resilient cushion 32. Sole attachment pin 34 is sized to frictionally fit into the toe separation cushion sole attachment pin apertures 20 (FIG. 2) to allow a user to position each toe separation cushion assembly 30 in a comfortable location.

Figure 4:
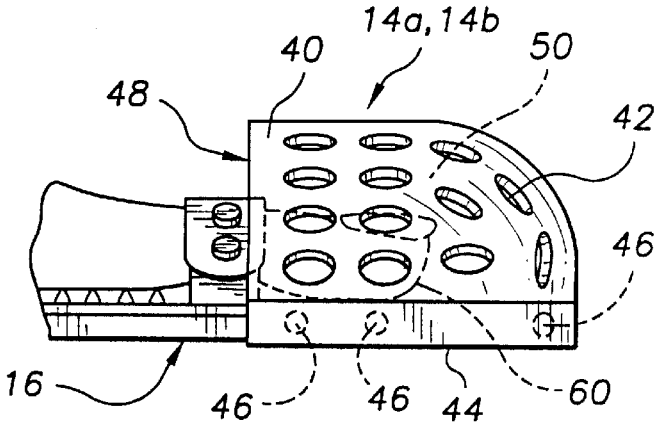
FIG. 4 is a partial plan view showing a toe portion of a user's foot positioned on the sole of one of the sandal assemblies with the user adjustable securing strap secured around the foot, the user's toes positioned within the interior toe receiving compartment of the toe area cover, and the toe area cover secured to the sole using the perimeter edge fasteners provided on the toe area cover and the companionate toe cover assembly fasteners provided on the side surface surrounding the toe area of the sole.

Referring to FIG. 4, toe area cover assembly 14*b* includes a partially dome shaped toe area cover 40 provided with a number of airflow apertures 42 and having a lower perimeter edge 44 provided with six perimeter edge fasteners 46 (only three shown in dashed lines) that are companionate with the six toe cover assembly fasteners 26 (FIG. 1) of sole 16. Partially dome shaped toe area cover 40 is open along the heel facing side 48 to allow the user to insert her toes into an interior toe receiving compartment 50 that is size to provide sufficient clearance between the users toes 60 (shown in dashed lines) and the top of partially dome shaped toe area cover 40.

It can be seen from the preceding description that a pedicure sandal system has been provided that includes sandal assemblies adapted to restrict movement of the wearer's toes and that are provided with oversized covers for covering and protecting the toes of the user; that includes user positionable toe separation cushion assemblies to provide proper toe positioning and spacing to each wearer; that includes two sandal assemblies and two toe area cover assemblies; each sandal assembly including a sole having a number of massaging dimples protruding upwardly therefrom and a number of toe separation cushion sole attachment pin apertures formed into the toe area of the sole, a user adjustable securing strap, a number of toe cover assembly fasteners provided on the side surface surrounding the toe area of the sole, and four toe separation cushion assemblies each including a resilient cushion sized to fit between the toes of a user and a cylinder shaped sole attachment pin projecting outwardly from the resilient cushion, the sole attachment pin being sized to frictionally fit into the toe separation cushion sole attachment pin apertures; each toe area cover assembly including a partially dome shaped toe area cover having a lower perimeter edge provided with perimeter edge fasteners companionate with the toe cover assembly fasteners provided on the side surface surrounding the toe area of the sole to hold the toe area cover in place with respect to the toe area of the sandal assembly; the toe area cover having a number of airflow apertures therethrough for providing airflow to the wearer's newly polished toe nails and an interior toe receiving compartment having sufficient clearance to receive the toes of a wearer therein without requiring contact being the wearer's toenails and the toe area cover.

It is noted that the embodiment of the pedicure sandal system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A pedicure sandal system comprising:

two sandal assemblies; and two toe area cover assemblies;

each sandal assembly including a sole having a number of massaging dimples protruding upwardly therefrom and a number of toe separation cushion sole attachment pin apertures formed into said toe area of said sole, a user adjustable securing strap, a number of toe cover assembly fasteners provided on a side surface surrounding said toe area of said sole, and four toe separation cushion assemblies each including a resilient cushion sized to fit between said toes of a user and a cylinder shaped sole attachment pin projecting outwardly from said resilient cushion, said sole attachment pin being sized to frictionally fit into said toe separation cushion sole attachment pin apertures;

each toe area cover assembly including a partially dome shaped toe area cover having a lower perimeter edge provided with perimeter edge fasteners companionate with said toe cover assembly fasteners provided on said side surface surrounding said toe area of said sole to hold said toe area cover in place with respect to said toe area of said sandal assembly;

said toe area cover having a number of airflow apertures therethrough for providing airflow to said wearer's newly polished toe nails and an interior toe receiving compartment having sufficient clearance to receive said toes of a wearer therein without requiring contact being said wearer's toenails and said toe area cover.

* * * * *